United States Patent [19]

Danowski

[11] 4,030,760

[45] June 21, 1977

[54] TIDDLYWINKS GAME

[75] Inventor: Edwin K. Danowski, Racine, Wis.

[73] Assignee: General Converters & Assemblers, Inc., Racine, Wis.

[22] Filed: Dec. 23, 1975

[21] Appl. No.: 643,752

[52] U.S. Cl. ..... 273/95 E

[51] Int. Cl.[2] ..... A63B 71/04

[58] Field of Search ..... 273/95 R, 95 E, 95 F, 273/95 H, 101, 102 R, 102 S, 105 R

[56] References Cited

UNITED STATES PATENTS

| | | | |
|---|---|---|---|
| 441,099 | 11/1890 | Hoyt | 273/95 E |
| 1,051,548 | 1/1913 | Bugbee | 273/105 R |
| 1,348,597 | 8/1920 | Stewart | 273/105 R |
| 1,541,980 | 6/1925 | Luber | 273/105 R |
| 1,636,920 | 7/1927 | Nichols | 273/105 R |
| 1,996,986 | 4/1935 | Weinberg | 273/105 R |
| 2,287,113 | 6/1942 | Markey | 273/105 R |
| 3,837,648 | 9/1974 | Breslow | 273/95 R |
| 3,941,382 | 3/1976 | Clark | 273/95 R |

OTHER PUBLICATIONS

Popular Mechanics Aug. 1958 vol. 110, No. 2 p. 178.

*Primary Examiner*—William H. Grieb
*Attorney, Agent, or Firm*—Peter N. Jansson

[57] ABSTRACT

A tiddlywinks game characterized by a major target surface slanted whereby shot disks falling thereon slide thereacross, and target receptacles, preferably cups, under the target surface and having open mouths flush with the surface. Preferred embodiments have a multiplicity of target receptacles having mouths of differing sizes at various locations on the target surface and having differing point values, a multiplicity of launch locations assigned point multipliers, and a reject receptor adjacent the lower edge of the slanted target surface and having portions assigned point values. The target surface is preferably hinged to a single planar surface forming the launch area and reject receptor.

14 Claims, 3 Drawing Figures

TIDDLYWINKS GAME

BACKGROUND OF THE INVENTION

This invention relates generally to the field of toys and games.

Tiddlywinks is a well known game of skill played by people of all ages. The game is played with shooter chips and shot disks and utilizes a launch area and a target receptacle such as a cup. The shooter chips are typically plastic disks similar to medium-sized coins and the shot disks are typically similar plastic disks somewhat smaller in size than the shooter disks. The object of the game is to shoot shot disks from the launch area into the target receptacle. A shot disk is placed on the launch area which is typically a felt-like surface covering a supportive backing material. The shooter chip is held by a participant between his thumb and index finger and its edge is applied with a degree of pressure to the flat surface of the shot disk. The shooter chip edge is moved across the shot disk until it snaps off the disk and onto the launch area, causing the shot disk to fly through the air toward the target receptacle. Typically, the distance of a shot depends upon the degree of pressure applied to the shot disk and the angle at which the shooter chip is held with respect to the shot disk at the time of release. Directional accuracy is dependent upon the line of contact between the shooter chip and the shot disk.

Mastery of tiddlywinks is dependent upon manual skill, that is, the development of the proper "feel" necessary to achieve the accuracy of direction and range required to shoot a shot disk into the target cup. Comparison of manual skill provides the primary competitive interest in the game of tiddlywinks. However, the basic game does not have great or lasting appeal for adults, primarily because it is lacking in competition value.

By this invention, an improved tiddlywinks game is provided which injects a large measure of additional mental activity into the basic game. The inventive game provides competitive interest both from a comparison of manual skills and from the use of the strategy and tactics made possible by this invention. The game is such that the best shooter can be beaten by a good shooter who excels in choice of targets, as will be made apparent hereafter. With such added competition value, the game is much more appealing to adults than the basic game of tiddlywinks.

The principal object of this invention is to provide an improved tiddlywinks game having improved competition value.

BRIEF DESCRIPTION OF THE DRAWINGS

This and other objects of the invention will be apparent from the description of preferred embodiments and from the drawings wherein.

DETAILED DESCRIPTION OF PREFERRED EMBODIMENTS

Throughout the drawings like numerals will be used to identify like parts.

Figure 1:
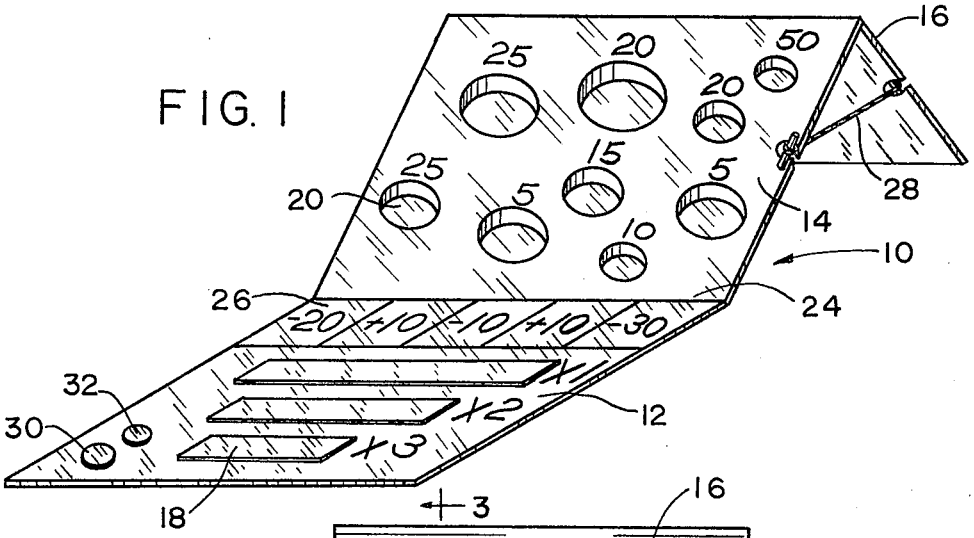
FIG. 1 is a perspective view of the game equipment of this invention.

FIG. 1 illustrates improved tiddlywinks game equipment 10 including, generally, launch area 12, major target surface 14, target surface support 16, and reject receptor strip 26. Launch area 12 is a flat, rigid board having a multiplicity of launch locations 18 which are felt pads glued to the board forming launch area 12. Major target surface 14 and reject receptor strip 26 are also made of a flat, rigid board material.

Figure 3:
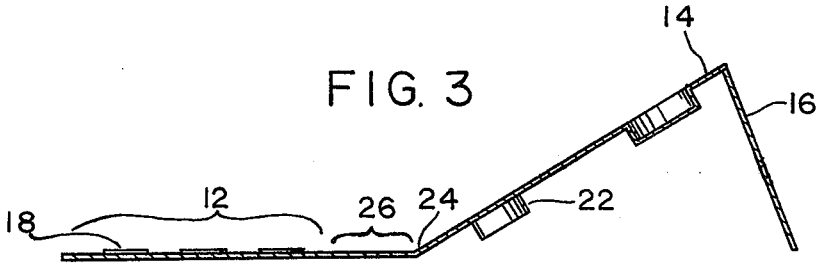
FIG. 3 is a side sectional taken along section 3—3 as shown in FIG. 2.

Defined in target surface 14 are a multiplicity of openings 20 to which are connected cups 22 which serve as target receptacles. Cups 22, illustrated in FIG. 3, are connected such that their open mouths are substantially flush with target surface 14.

Major target surface 14 is slanted with respect to a horizontal plane such that shot disks placed or falling thereon will slide thereacross to and beyond lowermost edge 24 of target surface 14. It is a primary object of the game to deposit shot disks 32 is cups 22, after snapping them with shooter chip 30. This may be accomplised either by a direct hit on cup 22, that is, the shot disk flying through the air directly through the open mouth of one of the cups 22, or by a shot disk hitting target surface 14 and sliding thereacross until it falls through an open mouth of one of the cups 22.

Adjacent lowermost edge 24 is a reject receptor strip 26. Shot disks sliding across target surface 14 without falling in one of the cups 22 will typically come to rest on reject receptor 26. Reject receptor strip 26 is coplaner with launch area 12 and is formed of the same board. The board forming launch area 12 and reject receptor strip 26 is hinged to lowermost edge 24 of target surface 14, thereby allowing target surface 14 to be folded over adjacent launch area 12 to dump shot disks from cups 22 at the end of a round of play.

The slant of target surface 14 may be achieved in a variety of ways. A fairly simple method is by use of target surface support 16 and connector pieces 28 which are engaged in slots along the lateral edges of target surface 14 and target surface support 16. Connector pieces 28 will maintain target surface support 16 in proper position.

Target surface 14 is made of a suitably smooth or slippery material such that shot disks 32 falling thereon will not be impeded in their slide thereacross. A wide variety of materials is suitable, including standard game board surfaces well known in the art. Target surface 14 may be in a single slant plane or it may be a simple or complex curved plane, or a series of planes. It is required, however, that the target surface be slanted to the horizontal to facilitate the aforementioned sliding action.

Figure 2:
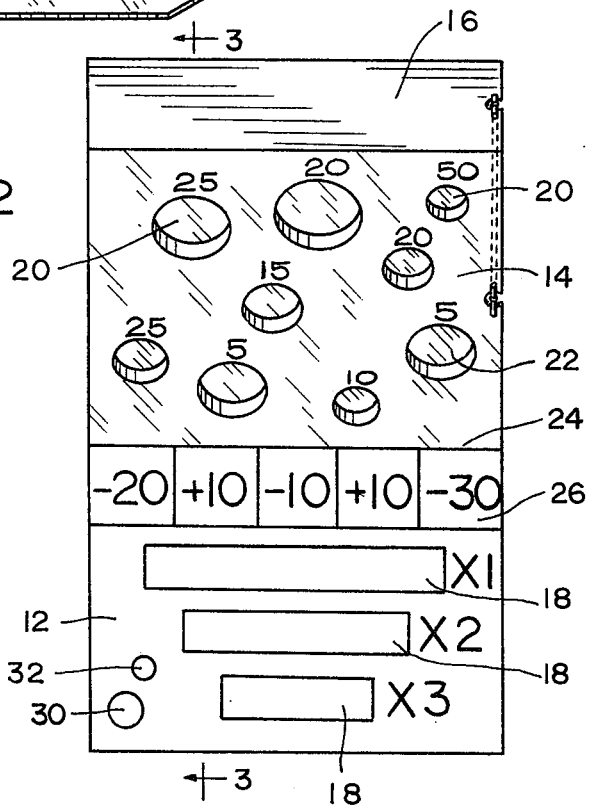
FIG. 2 is a top plan view.

As illustrated in the figures, a multiplicity of target receptacles 22 having open mouths of differing sizes are distributed across target surface 14. As shown in FIG. 2, different point values are assigned to target receptacles 22 according to the difficulty of shooting a shot disk thereinto, as determined by the size and location of the receptacle mouths. Generally speaking, the larger the mouth size, the lower the corresponding point value. Furthermore, target receptacles having mouths near the perimeter of target surface 14 will typically have higher assigned point values than target receptacles near the center of target surface 14, assuming other factors to be constant, because of the attendant risk of missing target surface 14 entirely in a shot aimed near the perimeter of the surface.

FIG. 2 also shows a multiplicity of launch locations 18 in launch area 12. Each launch location is assigned a point multiplier according to its relative distance from target surface 14. In the embodiment illustrated in the drawings, a shot disk placed in a 50-point cup from the launch location closest to target surface 14 would result in a score of 50 points while a shot disk placed in the same cup from the launch location farthest from target surface 14 would yield a score of 150 points. Point multipliers of various types may be used; the concept includes any means to award a higher score for hitting a given cup from a greater distance than would be awarded for hitting the same cup from a lesser distance.

Reject receptor strip 26 includes a multiplicity of portions assigned differing point values, including negative point values. Thus, in addition to considering the odds of missing a target receptacle, a participant must consider the possible results of such a miss when he is choosing the intended target for a given shot. Point values may be assigned to differing positions along lowermost edge 24 to correspond with the arrangement of target receptacles on target surface 14. For example, a high score receptacle may be on line with a severe negative score portion of reject receptor strip 26 to increase the risk which must be assumed when one is seeking a significant reward.

It will be apparent to someone familiar with this invention that it adds considerable interest to tiddlywinks competition. The great variety of target choices, the possibility of radically different scores when shooting from different distances from the target surface, and the attendant risks of various courses of action add a degree of strategy and tactics to tiddlywinks not heretofore known.

A great variety of materials may be used in constructing the game equipment used for this invention. Such would be obvious to those skilled in the art who are made aware of this invention. Many variations may be made from the specific embodiment shown. For example, cups 22 may be replaced by cloth bags or other receptacles. Furthermore, the open mouths of cups 22 may be replaced by mouths of differing shapes. Shooter chip 30 and shot disk 32, as shown in FIG. 1, may be replaced by pieces of different sizes and shapes as long as such pieces would function in the well-known and intended way.

While in the foregoing specification this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. In a tiddlywinks game of the type having shooter chips, shot disks, a launch area, and a target receptacle, the improvement comprising:

a major target surface, said surface both having sufficiently slippery surface characteristics and being sufficiently slanted to the horizontal whereby said shot disks may slide thereacross when thereon, said surface having a lowermost edge adjacent said launch area; and at least one target receptacle under and attached to said target area and having an open mouth flush with said major surface.

2. The game of claim 1 including a multiplicity of target receptacles having mouths of differing sizes at various locations on said target surface.

3. The game of claim 2 wherein different point values are assigned to said target receptacles.

4. The game of claim 1 wherein said launch area includes a multiplicity of launch locations at different distances from said target surface, said launch locations being assigned point multipliers according to their relative distances from said target area.

5. The game of claim 1 wherein a reject receptor is adjacent said lowermost edge whereby shot disks sliding off said target surface may come to rest thereon, said reject receptor including at least one portion to which a point value is assigned.

6. The game of claim 5 having a multiplicity of said portions at differing positions along said lowermost edge, said portions having differing point values.

7. The game of claim 3 wherein said launch area includes a multiplicity of launch locations at different distances from said target surface, said launch locations being assigned point multipliers according to their relative distances from said target area.

8. The game of claim 7 wherein a reject receptor is adjacent said lowermost edge whereby shot disks sliding off said target surface may come to rest thereon, said reject receptor including at least one portion to which a point value is assigned.

9. The game of claim 8 having a multiplicity of said portions at differing positions along said lowermost edge, said portions having differing point values.

10. The game of claim 8 wherein said launch area and said reject receptor form a unitary board and said major target surface is hinged at said lowermost edge to said board.

11. The game of claim 1 wherein said at least one target receptacle is a cup.

12. The game of claim 10 wherein said at least one target receptacle is a cup.

13. In a tiddlywinks game of the type having shooter chips, shot disks, a launch area, and a target receptacle, the improvement comprising:

a major target surface, said surface both having sufficiently slippery surface characteristics and being sufficiently slanted to the horizontal whereby said shot disks may slide thereacross when thereon, said surface having a lowermost edge adjacent said launch area; and at least one target receptacle attached to said target area.

14. The game of claim 13 including a multiplicity of target receptacles at various locations on said target surface.

* * * * *